US007500666B2

(12) United States Patent
Yanagishita

(10) Patent No.: US 7,500,666 B2
(45) Date of Patent: Mar. 10, 2009

(54) RECORDING MEDIUM FEEDING APPARATUS, RECORDING APPARATUS, LIQUID EJECTING APPARATUS

(75) Inventor: Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 32 days.

(21) Appl. No.: 11/858,985

(22) Filed: Sep. 21, 2007

(65) Prior Publication Data

US 2008/0088079 A1 Apr. 17, 2008

(30) Foreign Application Priority Data

Sep. 22, 2006 (JP) ..... 2006-257311

(51) Int. Cl.
*B65H 3/52* (2006.01)

(52) U.S. Cl. ..... 271/121; 271/124

(58) Field of Classification Search ..... 271/110, 271/111, 121, 124, 273, 10.02, 10.03
See application file for complete search history.

(56) References Cited

FOREIGN PATENT DOCUMENTS

| | | |
|---|---|---|
| JP | 2000-264459 | 9/2000 |
| JP | 2002-187634 | 7/2002 |
| JP | 2003-104573 | 4/2003 |
| JP | 2003-118874 | 4/2003 |
| JP | 2004-325714 | 11/2004 |
| JP | 2004-331300 | 11/2004 |
| JP | 08-099443 | 9/2007 |

*Primary Examiner*—Kaitlin S Joerger
(74) *Attorney, Agent, or Firm*—Workman Nydegger

(57) ABSTRACT

A front feeding device 3 is configured so that a first feeding mode in which switching operation of separating means 25 from a second state to a first state is started at the same time as when passage of the back end of a recording medium previously fed is detected by a paper detector 49 or after detected and a second feeding mode in which switching operation of the separating means 25 from the second state to the first state is started before passage of the back end of a recording medium previously fed is detected by the paper detector 49 can be switched.

8 Claims, 10 Drawing Sheets

RECORDING MEDIUM FEEDING APPARATUS, RECORDING APPARATUS, LIQUID EJECTING APPARATUS

BACKGROUND

1. Technical Field

The present invention relates to a recording medium feeding device for feeding a recording medium in a recording device such as a printer and to a recording device equipped with the same. Further, the present invention relates to a liquid ejecting apparatus.

Herein, the liquid ejecting apparatus in not limited to a recording device such as a printer, a copier, a facsimile, or the like in which an ink jet type recording head is used and for performing recording on a recording medium by ejecting ink from the recording head, and used to include an apparatus which eject a liquid corresponding to the application instead of ink from a liquid ejecting head corresponding to the ink jet type recording head on an medium to be recorded corresponding to the recording medium to adhere the liquid on the medium to be recorded.

As the liquid ejecting head, besides the recording head, there are included a color material ejecting head used for manufacture of a color filter such as a liquid crystal display, an electrode material (conductive paste) ejecting head used for manufacture of an electrode such as an organic EL display or field emission display (FED), a bioorganic material ejecting head used for manufacture of a biochip, a sample ejecting head as a minute pipette, and the like.

2. Related Art

A feeding device in which a recording paper as an example of a recording medium or a medium to be ejected can be set in a laminated state and for taking out and feeding the topmost one among the set recording papers one by one is provided in a recording device or a liquid ejecting apparatus represented by a facsimile or a printer.

Separating means for separating the topmost recording paper which should be fed from the following recording paper is provided in the feeding device so that the following recoding paper is not fed together when the topmost recording paper is taken out. There are various configurations as such separating means. As an example, there are included the one in which a recording paper is nipped between a rotating roller and a friction pad, the one in which a recording paper is nipped between a rotating roller and a retard roller to which a predetermined rotation torque is applied by a torque limiter mechanism, and the like. An example thereof is described in Patent Document 1 (JP-A-2004-331300).

By the way, transport means for precisely sending a recording paper is provided at the upstream side of recording means for recording on a recording paper, and detecting means for detecting the passage of the front end or the back end of a recording paper is often provided at the vicinity of the upstream side of the transport means. The detecting means is required to determine a recording starting position with respect to a recording paper and is preferable to be provided at a place as close as the recoding means in order to enhance the accuracy of the recording starting position. Further, by providing the detecting means at the place near the recording means in this manner, there is no need for providing the detecting means for every feeding device when a plurality of feeding devices are provided, and it is also advantageous in cost.

Consequently, when the next recording paper is fed subsequently to the recording paper previously fed, it is preferable that the feeding operation of the next recording paper from a paper feeding cassette is started when the passage of the back end of the preceding recording paper is detected by the above detecting means so that the back end of the recording paper previously fed is not overlapped with the front end of the next recording paper. Further, in the configuration in which the separating means is provided at the downstream side of the paper feeding cassette, in order to surly performing separation of recording papers, it is required that the separating means is switched to the state where the recording paper can be nipped at the period when the front end of the recording paper fed from the paper feeding cassette is passed through the separating means.

However, if the preparation operation of the separating means (switching operation from the state for not nipping recording paper to the state for nipping) is started when the passage of the back end of the preceding paper is detected by the detecting means, it is required to start the feeding operation of a recording paper after waiting a time required for the preparation operation. This prevents high throughput performance.

SUMMARY

The invention is made in the light of the circumstance, and the object of the invention is to enable to start feeding operation of the next recording paper rapidly after the passage of the back end of the preceding recording paper is detected without waiting the whole time required for preparation operation of separating means in a feeding device in which feeding operation of the next recording paper from a paper feeding cassette is started when the back end of the preceding recording paper is detected by detecting means.

In order to solve the above problem, in a first aspect of the invention, there is provided a recording medium feeding device equipped with a recording medium setting portion in which a plurality of recording mediums can be set in a laminated manner, feeding means for feeding the topmost one of recording mediums set in the recording medium setting portion to a feeding direction, separating means configured so that a first state in which two members oppositely disposed to sandwich a feeding path of the recording medium are pressed and a second state in which the press is released can be switched by the power of a motor, and for separating the topmost recording medium from the following recording medium by nipping the topmost recording medium which should be fed, and detecting means provided at a downstream side of the separating means and for detecting the passage of the front end or back end of the recording medium, and configured so that the front end of the topmost recording medium fed from the recording medium setting portion is passed through the separating means after the separating means is switched from the second state to the first state. Feeding of the next recording medium from the recording medium setting portion is not performed in the state where the passage of the back end of the recording medium previously fed is not detected by the detecting means, and a first feeding mode in which switching operation of the separating means from the second state to the first state is started at the same time as when the passage of the back end of the recording medium previously fed is detected by the detecting means or after detected and a second feeding mode in which switching operation of the separating means from the second state to the first state is started before the passage of the back end of the recording medium previously fed is detected by the detecting means can be switched when a plurality of recording mediums are fed.

According to the aspect, in the above second feeding mode, switching operation of the separating means from the second state to the first state is started before the passage of the back end of the recording medium previously fed is detected by the detecting means. Accordingly, the switching operation of the separating means from the second state to the first state is completed or at least the switching operation is advanced to some extent at the time when the passage of the back end of the recording medium previously fed is detected by the detecting means. Accordingly, the recording medium can be sent from the recording medium setting portion without waiting the whole time required for the switching operation of the separating means, so that throughput can be improved.

Further, in the first mode, switching operation of the separating means from the second state to the first state is started at the same time as when the passage of the back end of the recording medium previously fed is detected by the detecting means or after detected, so that it is surely prevented that the back end of the preceding recording medium is nipped by the separating means. Accordingly, a good recording result can be obtained at a time when recording to a recording medium is performed where back tension is remarkably occurred when the recording medium is nipped by the separating means or at a time when extremely high recording quality is required.

A second aspect of the invention is configured so that the switching operation of the separating means from the second state to the first state in the second feeding mode is completed before the passage of the back end of the recording medium previously fed is detected by the detecting means in the recording medium feeding device according to the first aspect.

According to the aspect, the switching operation of the separating means from the second state to the first state in the second feeding mode is completed before the passage of the back end of the recording medium previously fed is detected by the detecting means. Accordingly, feeding of the recording medium from the recording medium setting portion can be immediately performed without requiring a waiting time when the passage of the back end of the recording medium previously fed is detected by the detecting means.

A third aspect of the invention is configured so that the switching operation of the separating means from the second state to the first state in the second feeding mode is started when recording operation on the preceding recording medium is finished, or when transport operation of the recording medium to perform the last recording operation on the preceding recording medium is finished in the recording medium feeding device according to any of the first aspect or the second aspect.

According to the aspect, the switching operation of the separating means from the second state to the first state in the second feeding mode is started when recording operation on the preceding recording medium is finished, or when transport operation of the recording medium to perform the last recording operation on the preceding recording medium is finished. Accordingly no adverse influence in recording quality occurs even when the back end of the preceding recording medium is nipped by the separating means and back tension is occurred due the nipping.

A fourth aspect of the invention is configured so that the first feeding mode or the second feeding mode is selected in accordance with the type of the recording medium in the recording medium feeding device according to any of the first to third aspects.

According to the aspect, the first feeding mode or the second feeding mode is selected in accordance with the type of the recording medium. Accordingly, when recording is performed on a recording medium such as a dedicated paper in which a recording quality is emphasized, appropriate feeding control depending on the type of the recording medium can be performed, for example, by selecting the first feeding mode.

A fifth aspect of the invention is configured so that the second feeding mode is selected when the recording medium is a plain paper and the first feeding mode is selected when the recorded paper is a paper except a plain paper in the recording medium feeding device according to the fourth aspect.

According to the aspect, the second feeding mode is selected when the recording medium is a plain paper and the first feeding mode is selected when the recorded paper is a paper except a plain paper, so that the first feeding mode is selected when recording is preformed on a recording medium such as a dedicated paper in which recording quality is emphasized. The back end of the preceding recording medium is not nipped by the separating means in the first feeding mode, so that a high quality recording can be surely performed.

A sixth aspect of the invention is configured so that the switching operation of the separating means from the second state to the first state in the second mode is performed after the front end of the recording medium previously fed is detected by the detecting means, and after the back end of the recording paper is passed through the separating means based on size information of the recording medium in the recording medium feeding device according to any of the first to fifth aspects.

According to the aspect, the switching operation of the separating means from the second state to the first state is performed after the front end of the recording medium previously fed is detected by the detecting means, and after the back end of the recording paper is passed through the separating means based on size information of the recording medium. Accordingly, it is prevented that the back end of the preceding recording medium is nipped when the separating means is switched from the second state to the first state, and a high quality recording result can be always obtained.

In a seventh aspect of the invention, there is provided a recording device equipped with recording means for performing recording on a recording medium, and the recording medium feeding device according to any of the first to sixth aspects is equipped at the upstream side of the recording means. According to the aspect, the same effect similar to that of any of the above first to sixth aspect can be obtained.

In an eighth aspect of the invention, there is provided a liquid ejecting apparatus equipped with liquid ejecting means for performing liquid ejection on a medium to be ejected, a medium to be ejected setting portion in which a plurality of mediums to be ejected can be set in a laminated manner, feeding means for feeding the topmost one of mediums to be ejected set in the medium to be ejected setting portion to a feeding direction, separating means configured so that a first state in which two members oppositely disposed to sandwich a feeding path of the medium to be ejected are pressed and a second state in which the press is released can be switched by the power of a motor, and for separating the topmost medium to be ejected from the following medium to be ejected by nipping the topmost medium to be ejected which should be fed, and detecting means provided at a downstream side of the separating means and for detecting the passage of the front end or back end of the medium to be ejected, and configured so that the front end of the topmost medium to be ejected fed from the medium to be ejected setting portion is passed through the separating means after the separating means is switched from the second state to the first state. Feeding of the next medium to be ejected from the medium to be ejected setting portion is not performed in the state where the passage of the back end of the medium to be ejected previously fed is not detected by the detecting means, and a first feeding mode in which switching operation of the separating means from the second state to the first state is started at the same time as when the passage of the back end of the medium to be ejected previously fed is detected by the detecting means or after detected and a second feeding mode in which switching operation of the separating means from the second state to the first state is started before the passage of the back end of the medium to be ejected previously fed is detected by the detecting means can be switched when a plurality of mediums to be ejected are fed.

REFERENCE NUMERALS

Figure 1:
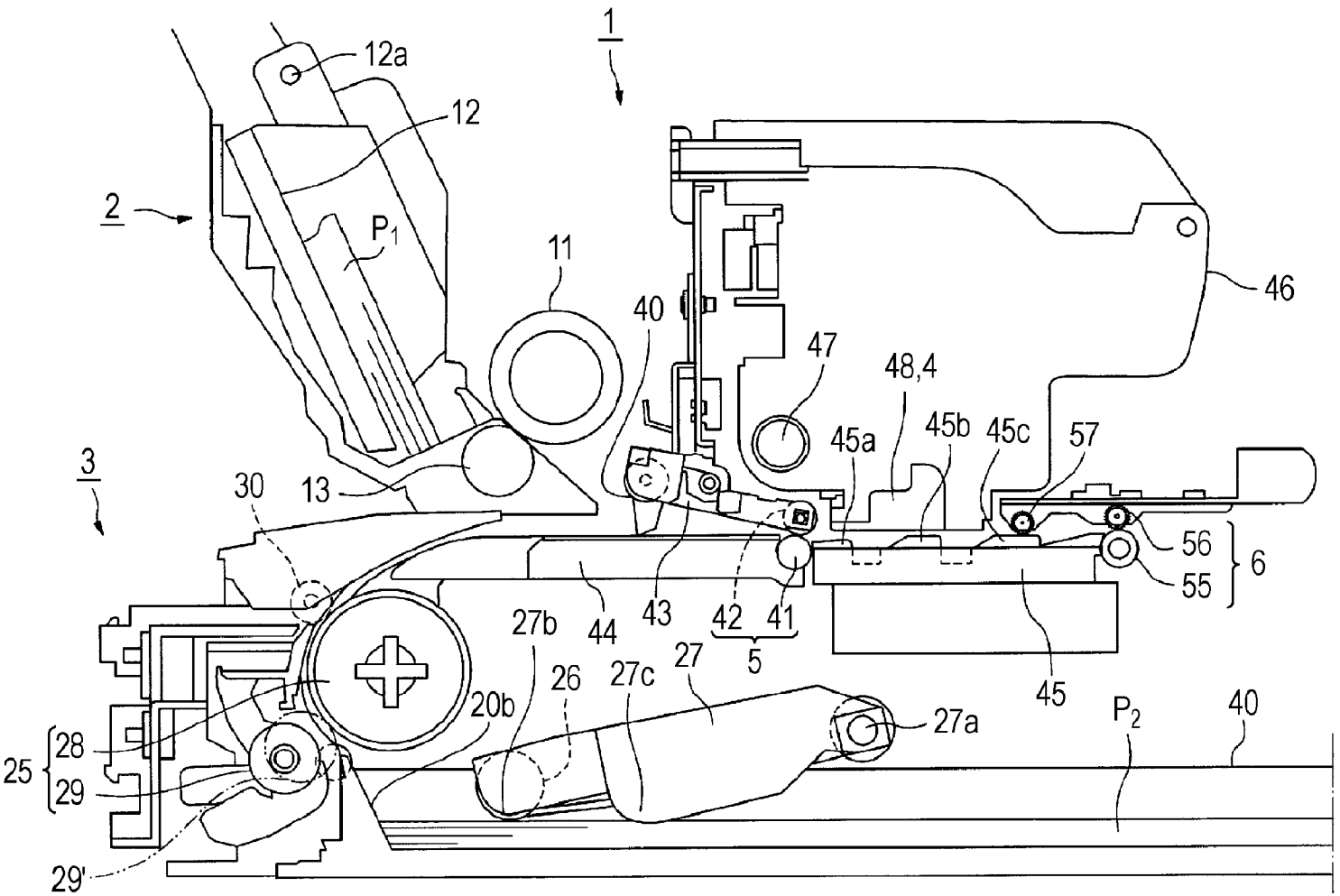
[FIG. 1] This is a side cross sectional view schematically showing a printer according to the invention.

1 ink jet printer
2 rear feeding device
3 front feeding device
4 recording means
5 transport means
6 ejecting means
11 feeding roller
12 hopper
13 retard roller
20 paper feeding cassette
20*a* storing portion
20*b* slide-contact face
20*c* protrusion
20*d* slope face
20*e* slope face
21*a*, 21*b* edge guide
22 regulating member
23 spring
24 rotation axis
25 separating means
26 pickup roller
27 roller support member
27*a* slide axis
27*b* raised area
27*c* cam follower portion
27*d* slope face
28 feeding roller
29 retard roller
30 assist roller
38 guide roller
40 guide roller
41 transport driving roller
42 transport driven roller
43 paper guide top
44 paper guide back
45 paper guide front
46 carriage
47 carriage guide axis
48 recording head
55 ejecting driving roller
56 ejecting driven roller
57 auxiliary roller
$P_1$, $P_2$ recording paper

DESCRIPTION OF EXEMPLARY EMBODIMENTS

Figure 2:
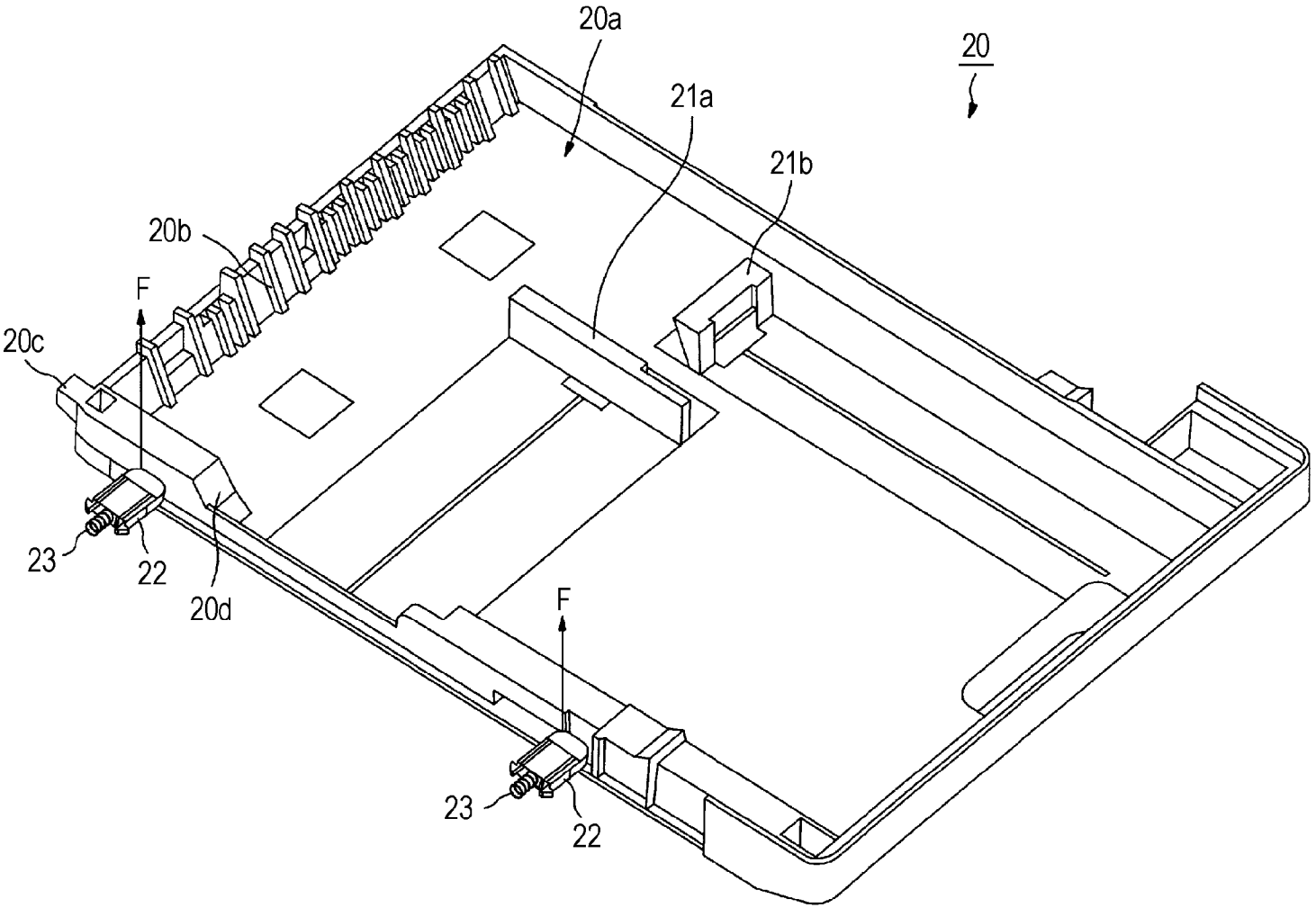
[FIG. 2] This is a perspective view of a paper feeding cassette.
Figure 3:
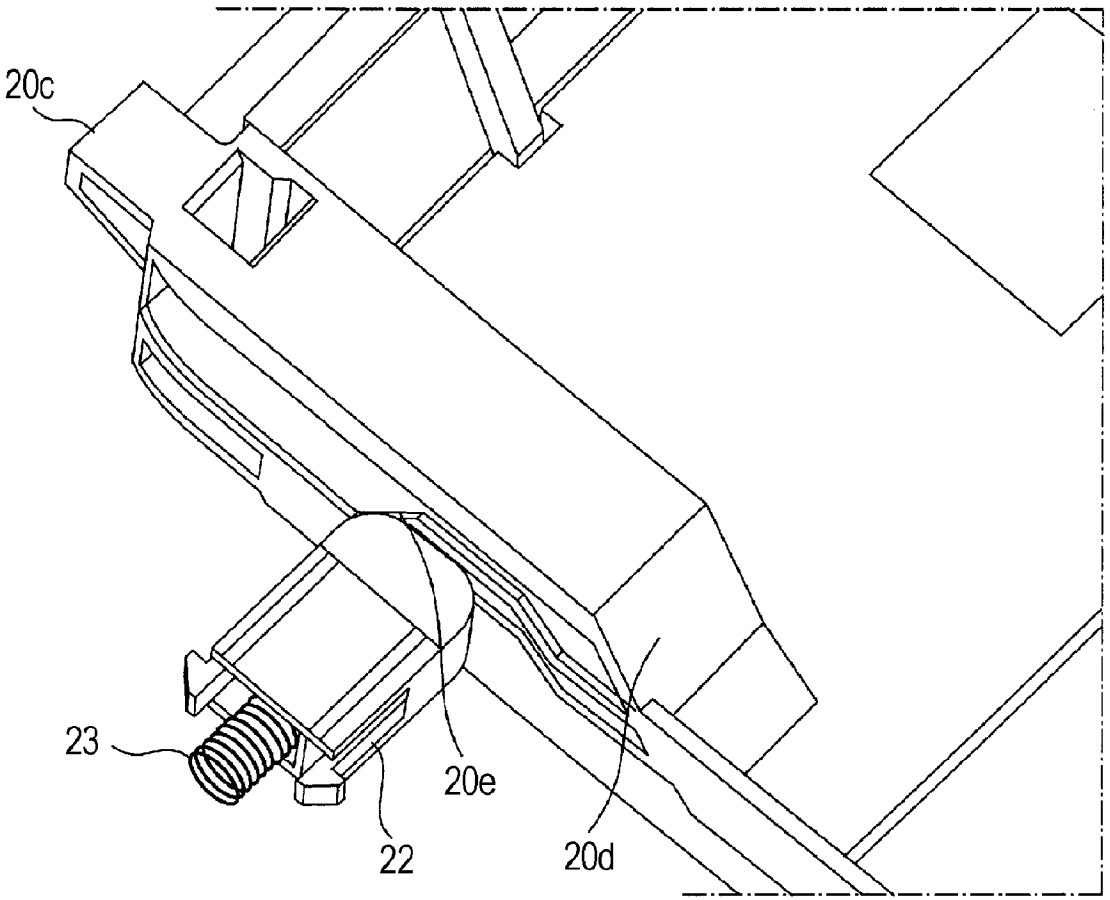
[FIG. 3] This is an enlarged view of a part of FIG. 2.
Figure 4:
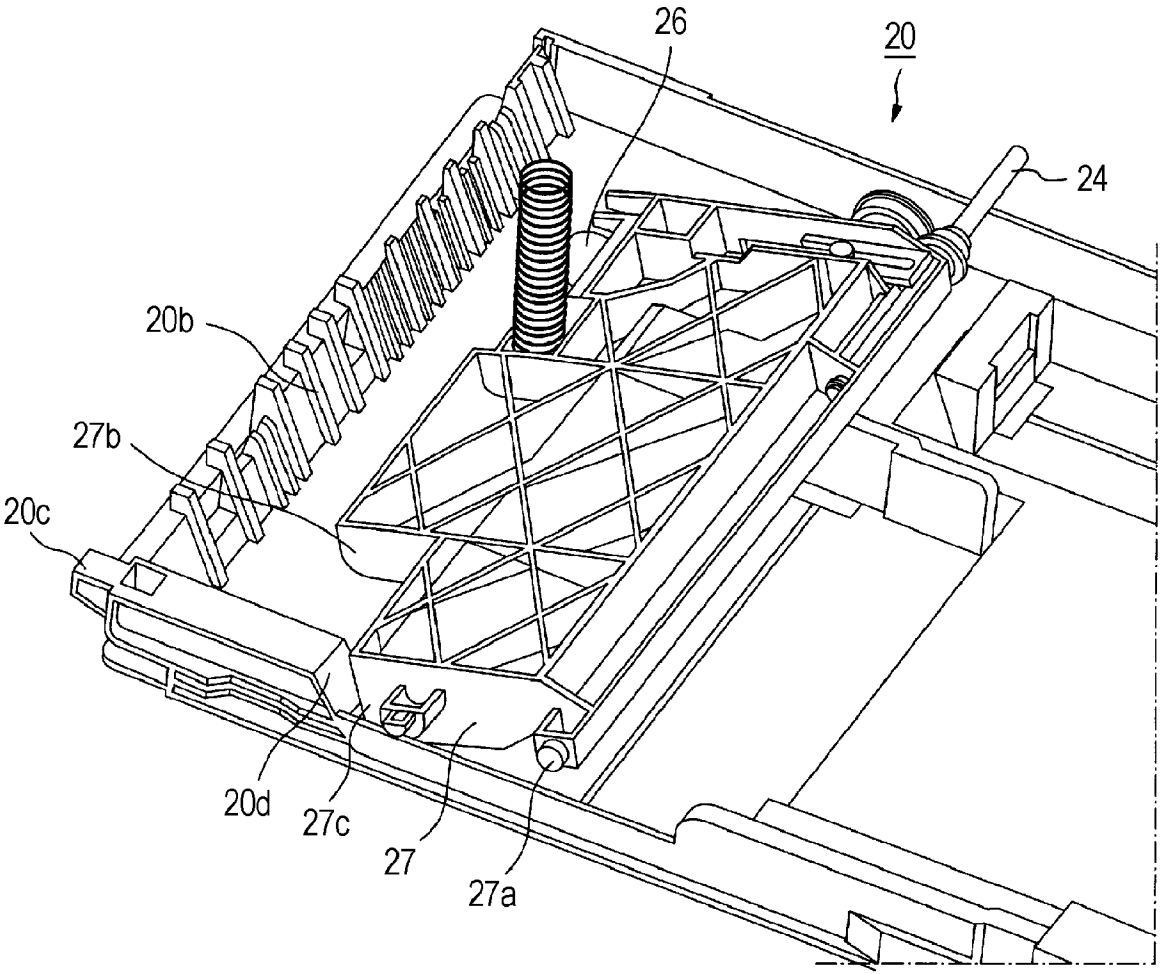
[FIG. 4] This is a perspective view of the paper feeding cassette and a roller support member.
Figure 5:
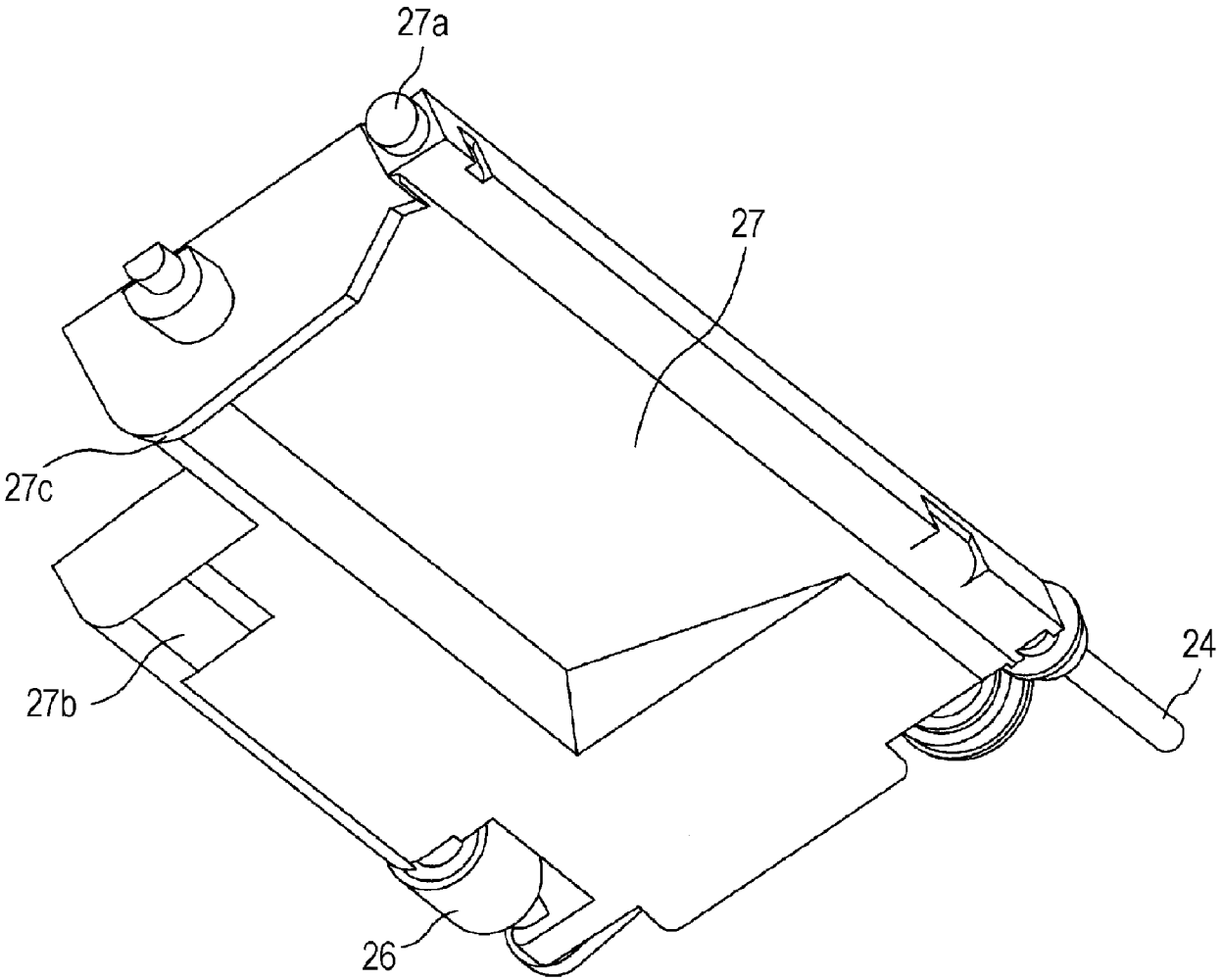
[FIG. 5] This is a perspective view of the roller support member viewed from the lower side.
Figure 6:
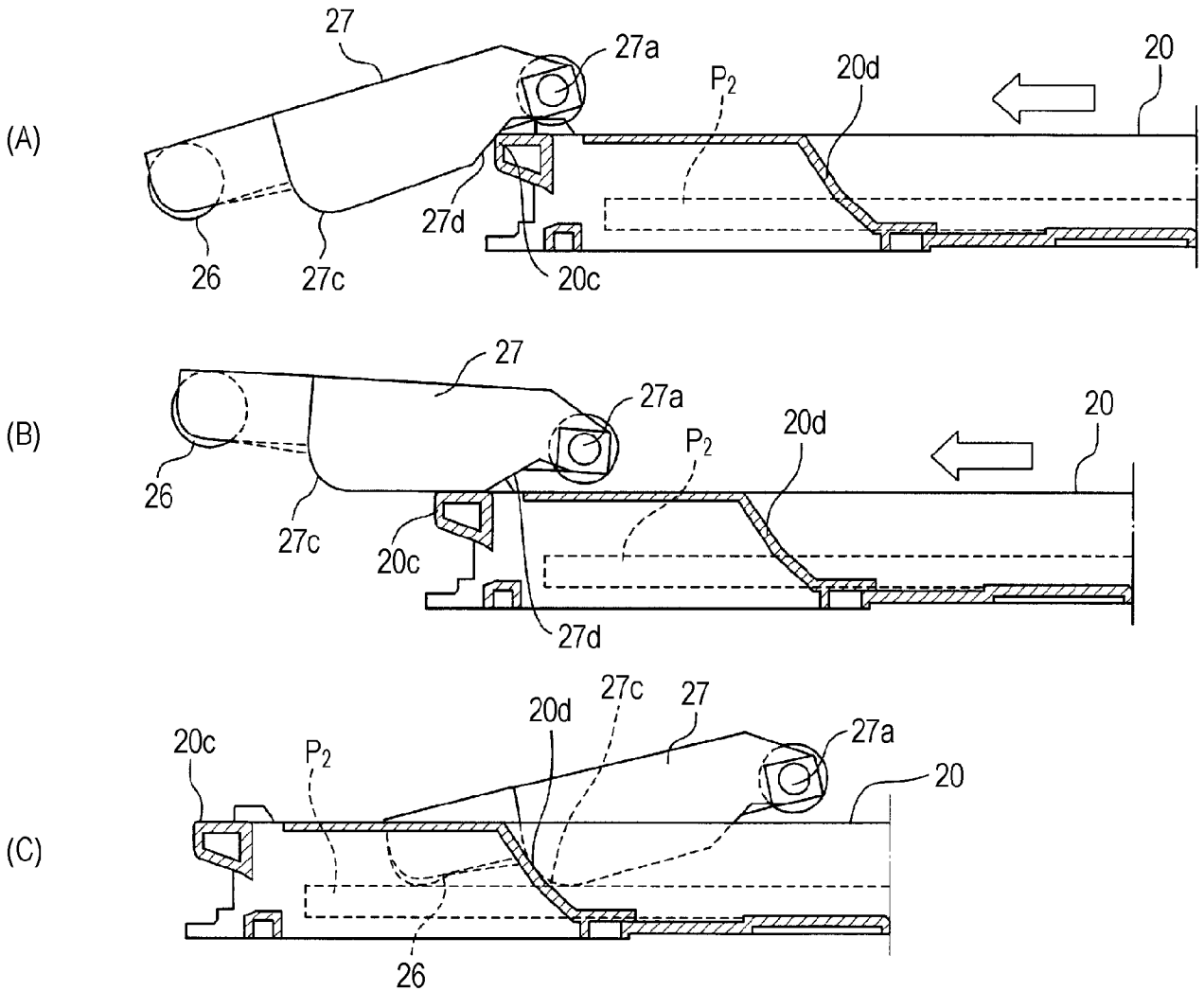
[FIG. 6] This is a lateral cross sectional view of the paper feeding cassette and a side view of the roller support member.
Figure 7:
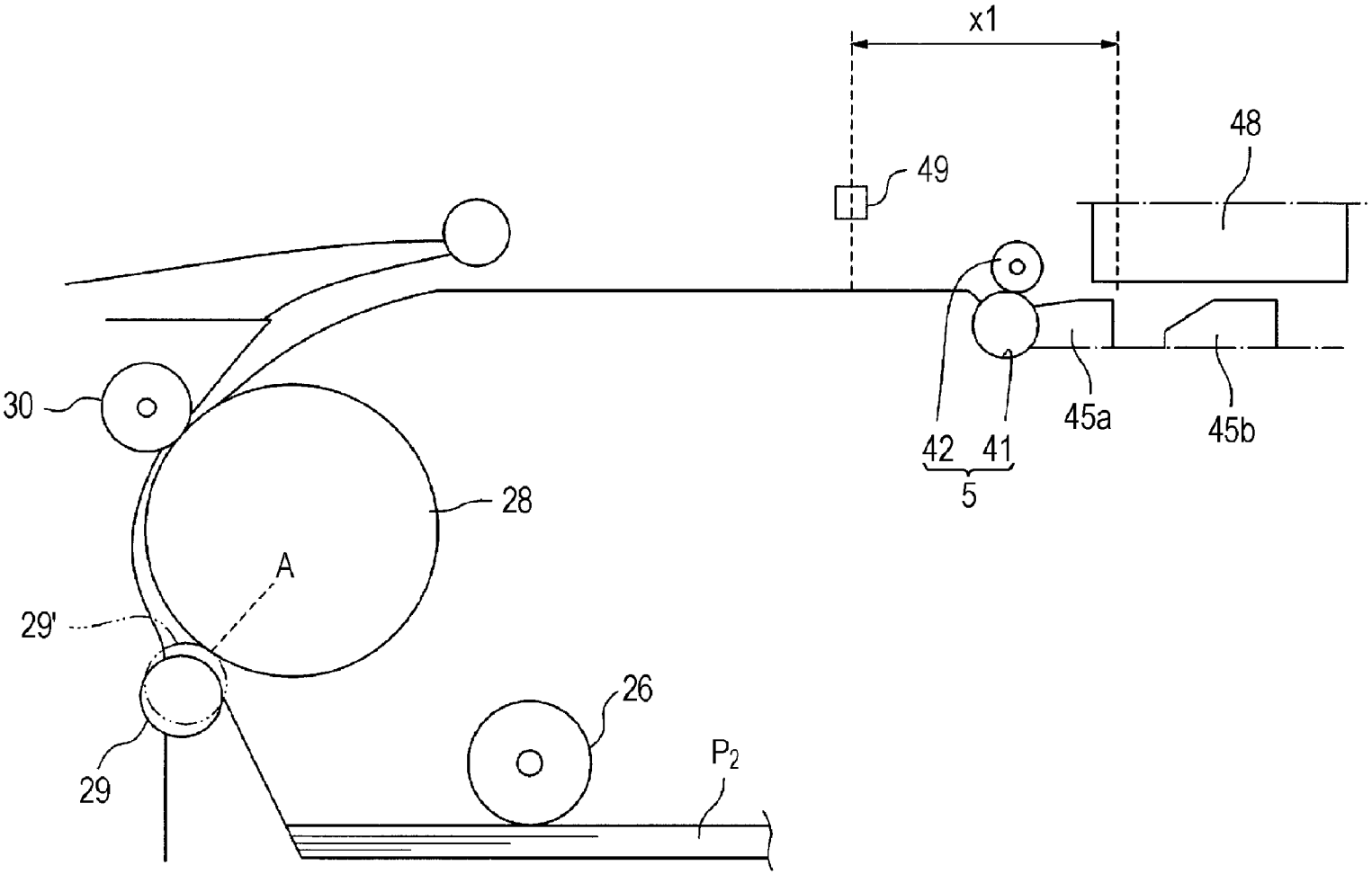
[FIG. 7] This is a diagram schematically showing a feeding path of a front feeding device.
Figure 8:
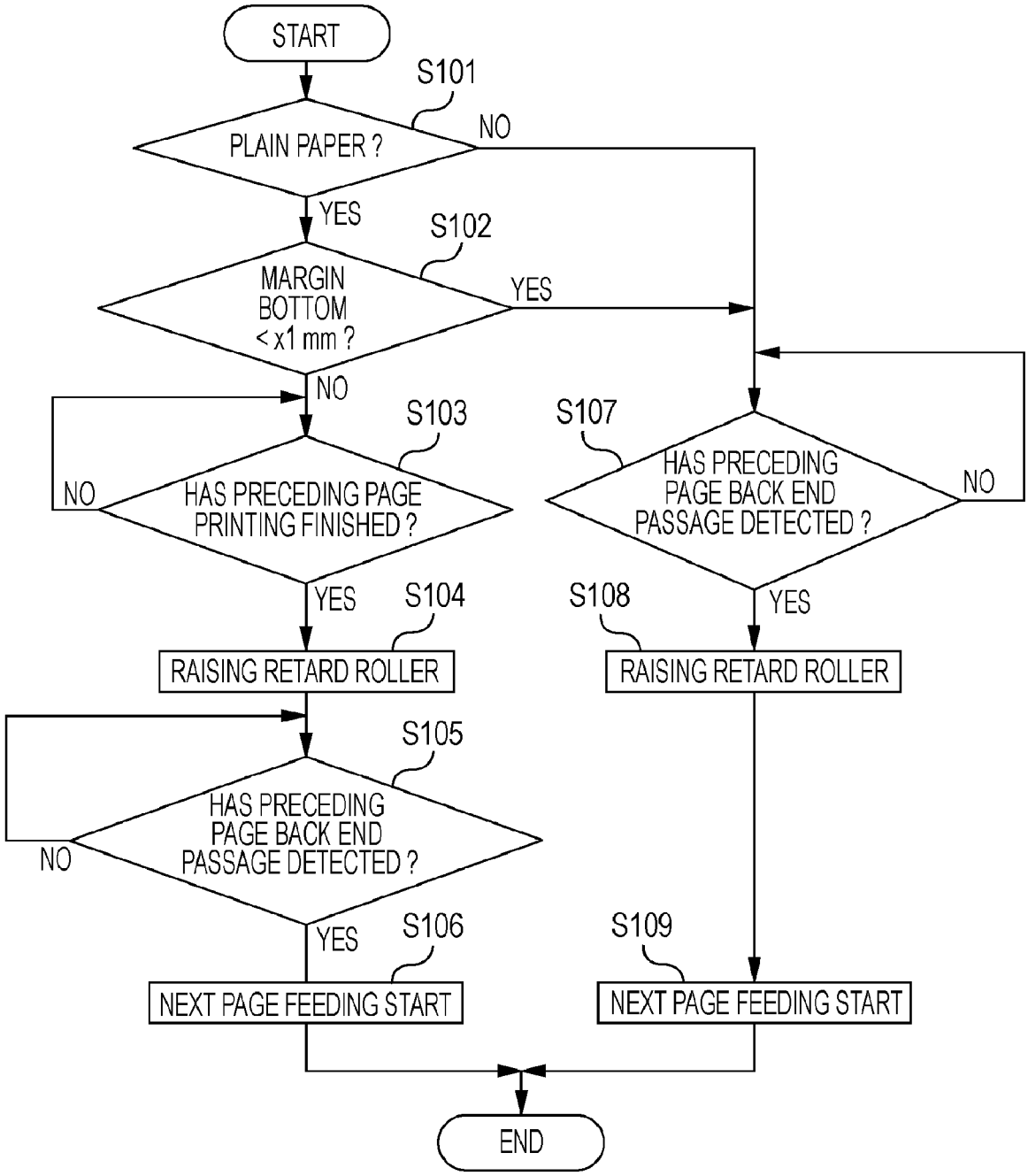
[FIG. 8] This is a flow chart showing an operation of separating means.
Figure 9:
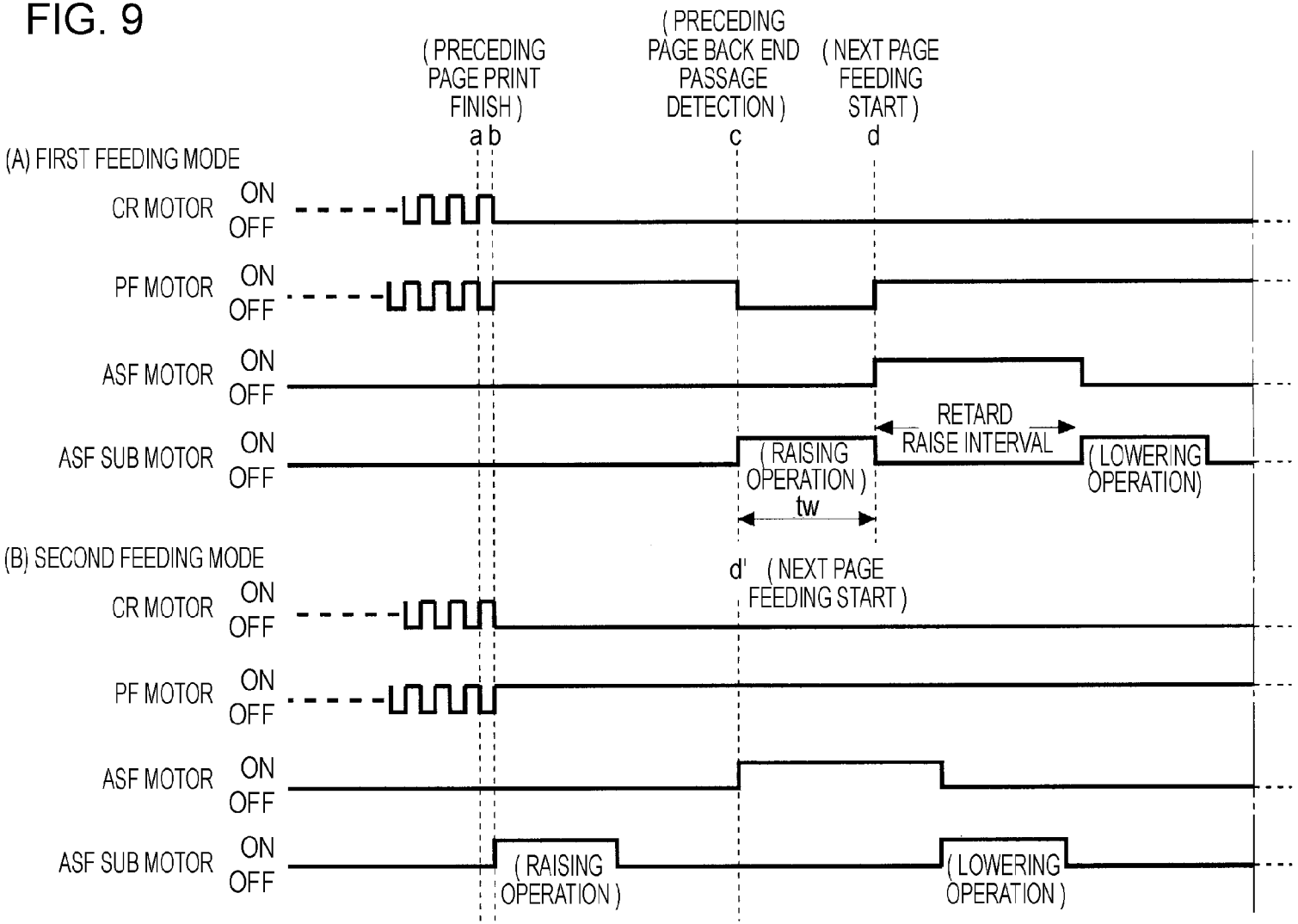
[FIG. 9] This is a flow chart showing an operation timing of each motor ((A) is a first feeding mode, ((B) is a second feeding mode).
Figure 10:
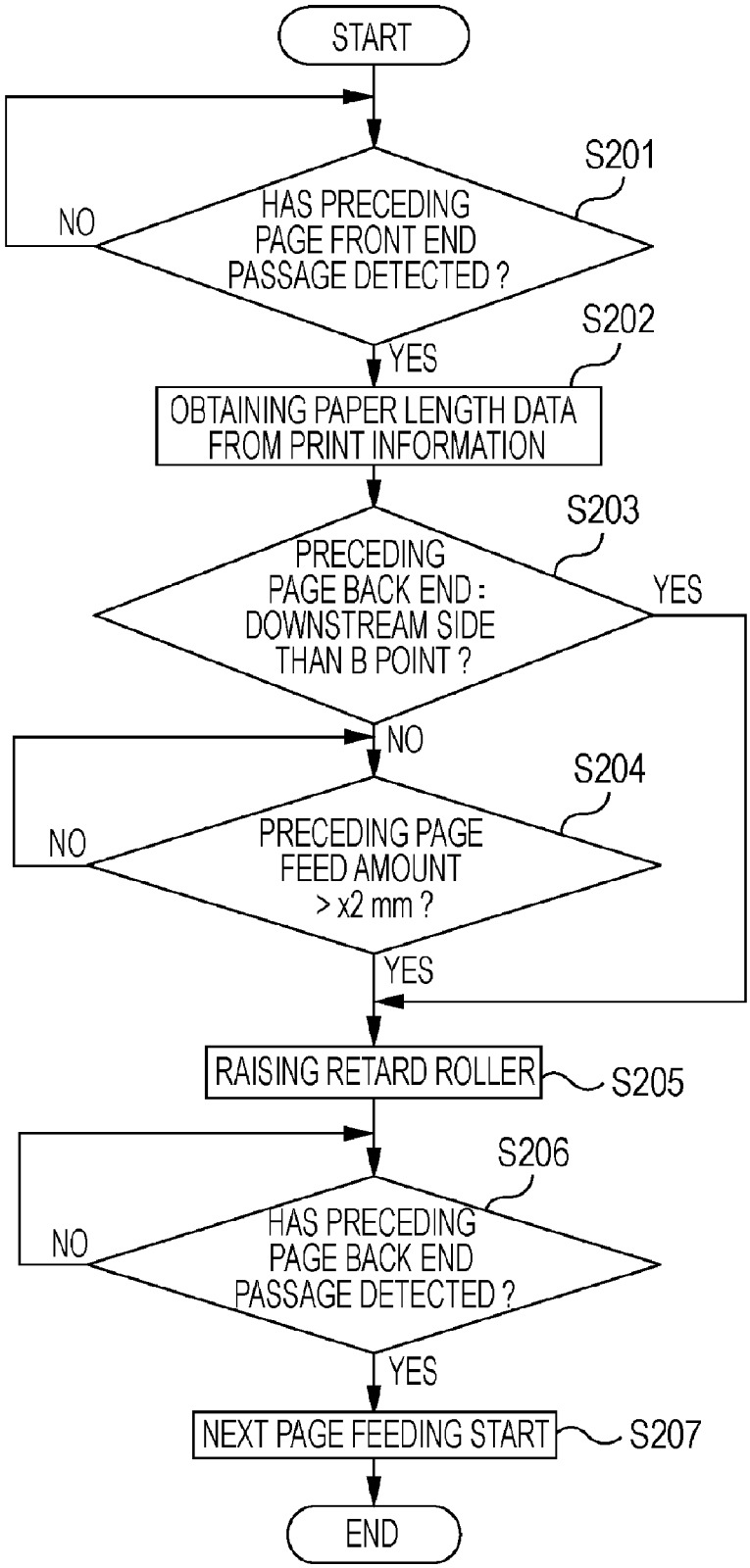
[FIG. 10] This is a flow chart showing an operation (another embodiment) of the separating means.

Hereinafter, an embodiment of the invention will be described with reference to FIG. 1 to FIG. 10. FIG. 1 is a side cross sectional view schematically showing an ink jet printer (hereinafter, referred to as a printer) 1 which is an embodiment of a "recording device" or a "liquid ejecting apparatus" according to the invention, FIG. 2 is a perspective view of a paper feeding cassette 20, FIG. 3 is an enlarged view of a part of FIG. 2, FIG. 4 is a perspective view of the paper feeding cassette 20 and a roller support member 27, FIG. 5 is a perspective view of the roller support member 27 viewed from the lower side, FIGS. 6(A) to 6(C) are each a lateral cross sectional view of the front portion of the paper feeding cassette 20 and a side view of the roller support member 27, and are diagrams showing transition of the engagement state of the both elements when the paper feeding cassette 20 is installed, FIG. 7 is a diagram schematically showing a feeding path of a front feeding device 3, FIG. 8 is a flow chart showing an operation of separating means 25, FIG. 9(A) is a timing chart showing an operation timing of each motor in a first feeding mode, FIG. 9(B) is a flow chart showing an operation timing of each motor in a second feeding mode (the horizontal axes thereof shall respectively be a time axis). Further, FIG. 10 is a flow chart showing an operation of the separating means 25 of another embodiment.

Structure of Printer

First, an entire structure of the printer 1 will be described below. The printer 1 shown in FIG. 1 is equipped with a plurality of feeding means, that is, equipped with a rear feeding device 2 at the rear of the device and a front feeding device 3 as a "recording medium feeding device" according to the invention at the bottom of the device. A recording paper as a "recording medium" or a "medium to be ejected" is fed to transport means 5. A recording paper is transported to the side of recording means 4 (a recording head 48) by the transport means 5 and ejected to a stacker not shown by ejecting means 6 after recording is performed.

Hereinafter, components on a paper transport (feed) path will be further described in detail.

The rear feeding device 2 is equipped with a hopper 12, a feeding roller 11, a retard roller 13, and other components not shown in FIG. 1.

The hopper 12 is formed by a plate body and provided so as to be able to slide around an upper sliding supporting point 12*a*. The posture of the hopper 12 is switched between a pressing posture for pressing the paper $P_1$ supported on the hopper 12 in an inclining posture to the feeding roller 11 and a detached posture for detaching from the feeding roller 11.

The feeding roller 11 has a circular shape and rotation thereof feeds the topmost paper $P_1$ pressed thereby to the downstream side. Note that hereinafter, the recording paper set in the rear feeding device 2 to be fed is referred to as "paper $P_1$" and the recording paper set in the front feeding device 3 to be fed is referred to as "paper $P_2$". Further, when it is not required to distinguish the both papers, the recording paper is referred to as "paper P" or simply referred to as a paper.

Next, the retard roller 13 is formed by an elastic material in the outer circumference, provided so as to be able to press the feeding roller 11, and provided in a state where a predetermined rotating resistance is applied by a torque limiter mechanism. Accordingly, when no multi feeding of the paper $P_1$ is occurred and only one paper is being fed, the retard roller 13 is rotatably driven with respect to the feeding roller 11. When a plurality of paper $P_1$ exist between the feeding roller 11 and the retard roller 13, the retard roller 13 does not rotate by the slipping operation between the papers and becomes stopped state, and multi feeding of the following $P_1$ is prevented. Note that, a paper return lever not shown is provided near the retard roller 13, and the following paper $P_1$ which are going to be multi fed is returned on the hopper 12 by the paper return lever.

On the other hand, the front feeding device 3 provided at the bottom of the printer 1 and configured to set the paper from the front direction of the device is equipped with a paper feeding cassette 20 constituting the "recorded medium setting portion", a pickup roller 26 constituting the "feeding means", two members (friction separating members) constituting (separating means), that is, a feeding roller 28 and a retard roller 29, an assist roller 30, and other components not shown.

A plurality of papers $P_2$ can be set in a laminated state in the paper feeding cassette 20 provided so as to be able to be freely attached and detached. An edge guide 21*a* whose position can be changed in the paper width direction and an edge guide 21*b* whose position can be changed in the paper length direction (feeding direction) are provided inside a storing portion 20*a*. These allow guiding the edges of the set paper $P_2$ at positions suitable for the paper size. Note that the paper $P_2$ set in the paper feeding cassette 20 is guided from the both sides by the edge guide 21*a* and the side wall of the paper feeding cassette 20.

Herein, the paper feeding cassette 20 is biased in the direction shown by the arrow F of FIG. 2 by regulating members 22, 22 of FIG. 2 when installed in the front feeding device 3 (approximately 45 degrees to the installed direction, that is, the direction of 1 column side direction and the paper feeding direction). The regulating member 22 is straightly biased toward the side wall of the paper feeding cassette 20 by a spring 22 to the main body side of the front feeding device 3 not shown, and the paper feeding cassette 20 is biased in the direction shown by the arrow F of FIG. 2 by pressing a slope face 20*e* (FIG. 3) formed at a side of the paper feeding cassette 20. The position of the paper in the column direction is uniformed and the feeding direction position of the paper $P_2$ set in the paper feeding cassette 20 is uniformed by biasing the paper feeding cassette 20 in the direction shown by the arrow F of FIG. 2. This provides feeding operation having no fluctuation.

Return to FIG. 1, the pickup roller 26 rotatably driven by a driving roller not shown is provided to a roller support member 27. The roller support member 27 is provided to be able to be slid around a sliding axis 27*a* and a rotation axis 24 (FIG. 4), and the pickup roller 26 can be made contact with and apart from the topmost paper $P_2$ set in the paper feeding cassette 20 by the sliding operation of the roller support member 27.

Then, by making contact with the topmost paper $P_2$ set in the paper feeding cassette 20 and rotating, the pickup roller 20 takes out the topmost paper $P_2$ from the paper feeding cassette 20 to send it toward the feeding direction. Note that the rotation axis 24 is a rotation axis driven by a motor not shown and transmits the power of the motor to the pickup roller 26.

A raised area 27*b* is formed in the roller support member 27 as shown in FIG. 5 and a curved posture of the paper $P_2$ is uniformed in the paper width direction by the raised area 27*b* and the retard roller 26. To be more specific, the retard roller 26 is disposed at 1 column side in the paper width direction (right upper direction in FIG. 4) and the retard roller 26 is to be disproportionately positioned at 1 column side of a paper depending on the paper size.

Accordingly, there is a fear in that the curved posture when curved and reversed so as to form an approximately U character shape by the feeding roller 28 provided at the downstream side becomes unevenness in the paper width direction and, for example, 80 column side is fed in first and skew is occurred. Consequently, the raised area 27*b* is formed at 80 column side of the roller support member 70 to uniform a curved posture of the paper $P_2$ in the paper width direction. Note that the raised area 27*b* is, as also shown in FIG. 1, formed to project as approximately the same as the outer circumference of the retard roller 26 with respect to the paper feeding path or to be a shape slightly receded than the retard roller 26 when viewed from the side of the paper feeding path.

Incidentally, the roller support member 27 is displaced in the lower direction in the state where the paper feeding cassette 20 is not installed (FIG. 6(A)), is pushed up in the upper direction by the paper feeding cassette 20 when the paper feeding cassette 20 is installed (FIG. 6(B)), and is displaced in the lower direction again so that the retard roller 26 presses a paper $P_2$ from the upper direction.

To be more specific, a protrusion 20*c* projecting in the installed direction shown in FIG. 2 to FIG. 4 is formed at the front end portion of the paper feeding cassette 20 at 80 column side. Further, a slope face 20*d* is formed at a portion opposite to the protrusion 20*c*. On the other hand, a cam follower portion 27*c* is formed to the roller support member 27. By engaging the com follower portion 27*c* with the protrusion 20*c* of the paper feeding cassette 20 and the slope face 20*d* operating as a cam, the roller support member 27 is pushed up by the protrusion 20*c* of the paper feeding cassette 20 with the install of the paper feeding cassette 20, and then, gradually displaced in the lower direction along the slope face 20*d*, and the retard roller 26 presses the paper $P_2$ from the upper direction.

Herewith, the paper $P_2$ in the paper feeding cassette 20 is prevented to be protruded in the feeding direction by the impact when the paper feeding cassette 20 is struck in the installed direction and multi feeding of the papers can be surely prevented. In particular, the wall surface inside the paper feeding cassette 20 at the installed direction side is a slide-contact face 20*b* (described below) forming a slope face opened in the upper direction, so that the paper $P_2$ in the paper feeding cassette 20 is easily protruded. However, the retard roller 26 presses the paper $P_2$ from upper direction when the paper feeding cassette 20 is struck in the installed direction, so that the protruding of the paper $P_2$ in the paper feeding cassette 20 in the feeding direction can be surely prevented.

Next, return to FIG. 1, the feeding roller 28 is rotatably driven by a motor not shown, inflects and reverses the topmost paper $P_2$ fed from the paper feeding cassette 20 in an approximately U character shape, that is, reverses in the direction opposite to the paper take out direction (left direction of FIG. 1), and feeds to the transport means via a paper guide back 44. That is, an inflection reverse feeding path for inflecting and reversing the paper $P_2$ for feed is formed by the outer circumferential surface of the feeding roller 28.

Subsequently, two separating portions (separating means) are provided to the front feeding device 3. A first separating portion is constituted by the slide-contact face 20*b* provided at a position opposing the front end of the paper set in the paper feeding cassette 20. That is, the front end of the paper $P_2$ fed in the feeding direction by the pickup roller 26 is sent to the downstream side while sliding the slide-contact face 20*b*. Herewith, the topmost paper $P_2$ which should be fed and the following paper $P_2$ which is going to be multi fed therewith are separated.

The second separating portion is separating means 25 constituted to include two friction separating members oppositely disposed with the feeding path interposed therebetween, that is, the feeding roller 28 and the retard roller 29. The retard roller 29 is provided so as to be able to be advanced and withdrawn with respect to the feeding roller 28 at a position opposing the outer circumferential surface of the feeding roller 28. The retard roller 29 can be switched between the state pressing the feeding roller 28 as shown in the reference numeral 29' (first state of the separating means 25) and the state where the pressing is released as shown in the reference numeral 29 (second sate of the separating means 25) by the power of a motor not shown.

The separating means 25 normally keeps the second state in order not to provide back tension to the paper being fed. However, when the paper $P_2$ is fed from the paper feeding cassette 20, the separating means 25 is switched from the second state to the first state, and after changed to the second state, the front end of the topmost paper $P_2$ fed from the paper feeding cassette is controlled to path through the nip point of the feeding roller 28 and the retard roller 29.

Note that the retard roller 29 is provided in the state where a predetermined rotation resistance is applied by a torque limiter mechanism similarly to the retard roller 13 of the rear feeding device 2 describe above. Accordingly, by nipping the fed topmost paper $P_2$ with the feeding roller 28, when multi feeding does not occur and only one paper is fed, the retard roller 29 is made contact with the paper $P_2$ and ratatably driven, and when there exists a plurality of papers $P_2$ between the feeding roller 28 and the retard roller 29, the retard roller 29 does not rotate by the slip operation between the papers and becomes the stop state. Herewith, the following paper $P_2$ which is going to be multi fed are held near the nip point of the feeding roller 28 and the retard roller 29 and multi feeding is prevented.

Next, the assist roller 30 is provided so as to be rotatably driven by making contact with the outer circumferential surface of the feeding roller 28 and assists the feeding of the paper $P_2$ according to the rotation of the feeding roller 28 by nipping the paper $P_2$ between with the feeding roller 28.

The structures of the rear feeding device 2 and the front feeding device 2 are described above. A paper detector 49 (omitted in FIG. 1, see FIG. 7) as detecting means for detecting the passage of the front end or the back end of the paper to be fed, a guide roller 40 for forming a feeding posture of a paper $P_1$ fed from the rear feeding device 2, and the paper guide back 44 for guiding the paper P to be fed to the transport means 5 are provided at the downstream side of the feeding devices.

The transport means 5 is constructed to include a transport driving roller 41 rotatably driven by a motor not shown and a transport driven roller 42 pivotally supported by a paper guide up 43 so as to press the transport driving roller 41 to be rotatably driven. The paper P reached the transport means 5 is transported to the recording means 4 (recording head 48) at the downstream side by rotation of the transport driving roller 41 in the state where the paper P is nipped by the transport driving roller 41 and the transport driven roller 42.

The recording head (liquid ejecting head) 48 is provided at the bottom of the carriage 46. The carriage 46 is driven so as to be moved back and forth in a main scanning direction by a driving motor not shown while being guided by a carriage guide axis 47 extending in the main scanning direction (front and back direction of the paper surface of FIG. 1). Further, ink cartridges (not shown) independent for every plurality of colors are mounted in the carriage 46 and ink is supplied to the recording head 48 from the ink cartridges.

A paper guide front 45 is provided at the position opposing the recording head 48 and the distance between the paper P and the head 48 is regulated by the paper guide front 45. Note that the ribs 45*a*, 45*b*, and 45*c* are formed at the portion of the paper guide front 45 opposing the recording head 48 from the upstream side, and so called margin-less printing is performed by ejecting ink also to the area separated from the front end of the paper or the back end of the paper in the state where the front end or the back end of the paper is positioned between each rib.

An auxiliary roller 47 for preventing lift of the paper P from the paper guide front 45 and ejecting means 6 for ejecting the paper P on which recording is performed are provided at the downstream side of the recording means 4. The ejecting means 6 is constructed to include an ejecting driving roller 55 rotatably driven by a motor not shown in the drawings and an ejecting driven roller 56 rotatably driven by making contact with the ejecting driving roller 55. The paper on which recording is performed is ejected to a stacker not shown by rotatably driving the ejecting driving roller 55 in the state where the paper is nipped by the ejecting driving roller 55 and the ejecting driven roller 56.

Feeding Modes of Front Feeding Device

The structure of the printer was described above. Hereinafter, feeding modes of the front feeding device 3 will be described with reference to FIG. 7 to FIG. 10.

The front feeding device 3 of the embodiment has two feeding modes (a first feeding mode and a second feeding mode) in which a switching timing of the retard roller 29 is different and is configured to be able to change the modes.

The feeding mode to be used for feed is determined by a control unit (not shown in the drawings) of the printer 1 based on the type of the paper on the basis of the print setting information received from a host computer (not shown in the drawings) connected to the printer 1 or the print setting information input from the operation panel (not shown in the drawings) of the printer 1.

Specifically, as a rule, the second mode is selected when the type of the paper is a "plain paper" and the first mode is selected when the type of the paper is a paper except a "plain paper". However, the first mode may be exceptionally selected when the margin of the back end of the paper is small even when the type of the paper is a "plain paper". Note that the "dedicated paper" as used herein denotes a paper formed by a plurality of layers equipped with a coat layer on a recording surface and the "plain paper" as used herein denotes a paper formed by a single layer.

A common point of the first feeding mode and the second feeding mode is that feeding operation of the next paper $P_2$ from the paper feeding cassette 20 (that is, rotation of the pickup roller 26) is not started in the state where the passage of the back end of the paper $P_2$ previously fed is not detected by the paper detector 49. Further, although the separating means 25 is usually kept in the first state in order not to apply back tension to the paper, the separating means 25 is switched from the first state to the second state before the front end of the paper is passed though the separating means 25 when feeding the paper. This point is also common for the above two feeding modes.

A different point is that timing for starting the switching operation from the second state to the first state of the separating means 25. In the first feeding mode, the switching operation is started at the same time as when the passage of the back end of the paper $P_2$ previously fed is detected by the detector 49, or after detected, and then the feeding operation of the next paper is started. On the other hand, in the second mode, the switching operation is started before the passage of the back end of the paper $P_2$ previously fed is detected by the detector 49, and then the feeding operation of the next paper is started.

Hereinafter, the detail of each feeding mode will be described with reference to FIG. 8 and FIG. 9. Note that the "CR motor" in FIG. 9 denotes a motor for driving the carriage 46, the "PF motor" denotes a motor for driving the transport driving roller 41 and the feeding roller 28, the "ASF motor" denotes a motor for driving the feeding roller 11 and the pickup roller 26, and the "ASF sub motor" denotes a motor as a driving source for performing forward and backward operation of the retard roller 29 with respect to the feeding roller 28.

As shown in FIG. 8, whether the type of the paper is a plain paper of not is judged at the time when feeding operation is started (step S101), and in the case of a plain paper (positive branch), whether the margin bottom is smaller than x1 mm or not is judged (step S102). Herein, x1 mm is an interval distance between a nozzle position of the recording head 48 and the paper detector 49 as shown in FIG. 7, and the nozzle position is a position of the nozzle at the most upstream side in the last main scanning of the recording head 48.

That is, when the margin bottom is smaller than x1 mm (positive branch in step S102), the back end of the paper is already passed through the paper detector 49 when the recording is finished. In this manner, when the back end of the paper is already passed through the paper detector 49 when the recording is finished, the switching operation (also referred to as raising operation of retard roller 29) from the second state to the first state of the separating means 25 is started when the passage of the back end of the preceding paper (page) is detected by the paper detector 49 (step S107, S108). Note that, the c point of the timing chart shown in FIG. 9(A) is a point at which the passage of the back end of the preceding paper is detected by the paper detector 49.

Then, when the raising operation of the retard roller 29 is completed (d point of FIG. 9(A)), the feeding operation of the paper $P_2$ of the next page from the paper feeding cassette 20 is started (step S109). This is the first feeding mode and is performed not only when the margin bottom is small in the case of a plain paper, but also in the case of a dedicated paper (negative branch of step S101).

On the other hand, when the margin bottom is large (negative branch of step S102), the raising operation of the retard roller 29 is started when the printing of the preceding paper (page) is finished (positive branch of step S103, step S104). Note that the b point of the timing chart shown in FIG. 9(B) is a point at which the printing operation with respect to the preceding paper is finished, and more specifically, shows a time when the last main scanning by the recording head 48 is finished. Further, the a point shows a time when the last paper transport operation by the transport driving roller 41 (FIG. 1) for performing the last main scanning is finished.

In the example of FIG. 8, the retard roller 29 stats raising operation at the b point of FIG. 9(B). However, the point may be the a point. That is, a timing at which no influence is applied to recording quality may be employed even when back tension is applied by nipping the back end of the preceding paper by the separating means 25.

Then, feeding operation of the paper $P_2$ of the next page is started when the passage of the back end of the preceding paper is detected by the paper detector 49 (positive branch of step S105, S106). Herewith, the overlapping of the back end of the preceding paper end and the front end of the next paper can be surely prevented.

As described above, in the second feeding mode, the switching operation from the second state to the first state of the separating means 25 is started before the passage of the back end the paper previously fed is detected by the paper detector 49 (the a point or the b point of FIG. 9(B)). Accordingly, the feeding operation of the paper from the paper feeding cassette 20 can be started without waiting the whole time required for the switching operation of the separating means 25 (the d' point of FIG. 9(B): ON of the ASF motor), so that throughput can be improved. Note that the area (time) shown by the symbol tw of FIG. 9(B) shows an abbreviated time by the second feeding mode when compared with the first feeding mode.

In particular, in the embodiment, the switching operation from the second state to the first state of the separating means 25 is completed at the time when the passage of the back end of the paper previously fed is detected by the paper detector 49 (see "raise interval" of FIG. 9(B)), it is not required to wait the switching operation at all. Accordingly, further improvement of throughput can be provided.

Further, in the first feeding mode, the switching operation of the second state to the first state of the separating means 25 is started at the same time as when the passage of the back end of the paper previously fed is detected by the paper detector 49, or after detected, therefore it can be surely prevented that the back end of the preceding paper is nipped by the separating means 25, and occurrence of back tension during recording can be surely prevented. Consequently, a good recording result can be obtained in the recording mode required high recording quality.

By the way, the switching operation of the second state to the first state of the separating means 25 in the second feeding mode may be performed after the front end of the paper previously fed is detected by the detector 49 and after the back end of the paper is passed through the separating means 25 based on paper size information.

FIG. 10 shows such an embodiment. When the passage of the front end of the preceding paper is detected by the detector 49 (step S201), paper length data is obtained from print information (step S202), and whether the back end of the preceding paper is present at the downstream side than the separating means 25 (the nipping point of the retard roller 29 and the feeding roller 28: A point of FIG. 7) or not is judged (step S203). When the back end of the preceding paper is present at the downstream side (positive branch of the step S203), the switching operation from the second state to the first state of the separating means 25 (raising operation of the retard roller 29) is performed (step S205).

In the case of the negative branch of step S203, that is, when the back end of the paper is present at the upstream side than the separating means 25 when the passage of the front end of the preceding paper is detected by the paper detector 49, the preceding paper is fed to the downstream side till the back end thereof is passed through the separating means 25 (the feeding amount at this time shall be x2 mm), and thereafter, the switching operation from the second state to the first state of the separating means 25 is performed (step S205).

By switching the separating means 25 from the second state to the first state after the back end of the preceding paper is passed through the separating means 25, it is prevented that the back end of the preceding paper is nipped when the separating means 25 is switched from the second state to the first state, and a high quality recording result can be always obtained. Further, even when recording to the preceding paper is being performed, the separating means 25 is switched from the second state to the first state when the back end of the paper being recorded is passed through the separating means 25. Consequently, the switching of the state of the separating means 25 can be completed at further early stage as compared with the case where the switching of the state of the separating means 25 is performed after the recording operation to the preceding paper is completed.

What is claimed is:

1. A recording medium feeding device comprising:

a recording medium setting portion in which a plurality of recording mediums can be set in a laminated manner;

feeding means for feeding the topmost one of recording mediums set in the recording medium setting portion to a feeding direction;

separating means configured so that a first state in which two members oppositely disposed to sandwich a feeding path of the recording medium are pressed and a second state in which the press is released can be switched by the power of a motor, and for separating the topmost recording medium from the following recording medium by nipping the topmost recording medium which should be fed; and detecting means provided at a downstream side of the separating means and for detecting the passage of the front end or back end of the recording medium, and configured so that the front end of the topmost recording medium fed from the recording medium setting portion is passed through the separating means after the separating means is switched from the second state to the first state, wherein feeding of the next recording medium from the recording medium setting portion is not performed in the state where the passage of the back end of the recording medium previously fed is not detected by the detecting means, and a first feeding mode in which switching operation of the separating means from the second state to the first state is started at the same time as when the passage of the back end of the recording medium previously fed is detected by the detecting means or after detected and a second feeding mode in which switching operation of the separating means from the second state to the first state is started before the passage of the back end of the recording medium previously fed is detected by the detecting means can be switched when a plurality of recording mediums are fed.

2. The recording medium feeding device according to claim 1, wherein the switching operation of the separating means from the second state to the first state in the second feeding mode is completed before the passage of the back end of the recording medium previously fed is detected by the detecting means.

3. The recording medium feeding device according to claim 2, wherein the switching operation of the separating means from the second state to the first state in the second feeding mode is started when recording operation on the preceding recording medium is finished, or when transport operation of the recording medium to perform the last recording operation on the preceding recording medium is finished.

4. The recording medium feeding device according to claim 2, wherein the first feeding mode or the second feeding mode is selected in accordance with the type of the recording medium.

5. The recording medium feeding device according to claim 4, wherein the second feeding mode is selected when the recording medium is a plain paper and the first feeding mode is selected when the recorded paper is a paper except a plain paper.

6. The recording medium feeding device according to claim 2, wherein the switching operation of the separating means from the second state to the first state in the second mode is performed after the front end of the recording medium previously fed is detected by the detecting means, and after the back end of the recording paper is passed through the separating means based on size information of the recording medium.

7. A recording device equipped with recording means for performing recording on a recording medium, wherein the recording medium feeding device according to claim 2 is equipped at the upstream side of the recording means.

8. A liquid ejecting apparatus comprising:

liquid ejecting means for performing liquid ejection on a medium to be ejected;

a medium to be ejected setting portion in which a plurality of mediums to be ejected can be set in a laminated manner;

feeding means for feeding the topmost one of mediums to be ejected set in the medium to be ejected setting portion to a feeding direction;

separating means configured so that a first state in which two members oppositely disposed to sandwich a feeding path of the medium to be ejected are pressed and a second state in which the press is released can be switched by the power of a motor, and for separating the topmost medium to be ejected from the following medium to be ejected by nipping the topmost medium to be ejected which should be fed; and detecting means provided at a downstream side of the separating means and for detecting the passage of the front end or back end of the medium to be ejected, and configured so that the front end of the topmost medium to be ejected fed from the medium to be ejected setting portion is passed through the separating means after the separating means is switched from the second state to the first state, wherein feeding of the next medium to be ejected from the medium to be ejected setting portion is not performed in the state where the passage of the back end of the medium to be ejected previously fed is not detected by the detecting means, and a first feeding mode in which switching operation of the separating means from the second state to the first state is started at the same time as when the passage of the back end of the medium to be ejected previously fed is detected by the detecting means or after detected and a second feeding mode in which switching operation of the separating means from the second state to the first state is started before the passage of the back end of the medium to be ejected previously fed is detected by the detecting means can be switched when a plurality of mediums to be ejected are fed.

* * * * *